US006623410B2

(12) United States Patent
Tang

(10) Patent No.: US 6,623,410 B2
(45) Date of Patent: Sep. 23, 2003

(54) ACTUATION MECHANISM OF EXERCISER

(76) Inventor: Jack Tang, 1 Fl., No. 7, Alley 27, Lane 247, Chung-Cheng Rd., Hsin-Tien, Taipei County (TW)

( * ) Notice: Subject to any disclaimer, the term of this patent is extended or adjusted under 35 U.S.C. 154(b) by 173 days.

(21) Appl. No.: 09/942,506

(22) Filed: Aug. 30, 2001

(65) Prior Publication Data

US 2002/0183175 A1 Dec. 5, 2002

(30) Foreign Application Priority Data

Jun. 1, 2001 (TW) ..... 90209096

(51) Int. Cl.[7] ..... A63B 21/00
(52) U.S. Cl. ..... 482/126; 482/121; 482/124
(58) Field of Search ..... 482/130, 126, 482/121–125, 111, 907, 44, 148, 127, 142, 140, 129, 139

(56) References Cited

U.S. PATENT DOCUMENTS 1,680,901 A * 8/1928 Meyer ..... 482/126
5,674,164 A * 10/1997 Kravitz ..... 482/126
6,120,421 A * 9/2000 Kuo ..... 482/111
6,254,517 B1 * 7/2001 Kennedy ..... 482/121
6,387,023 B1 * 5/2002 Liga, Jr. ..... 482/130
6,436,017 B1 * 8/2002 Chen ..... 482/121
6,517,469 B1 * 2/2003 Mercier ..... 482/126

FOREIGN PATENT DOCUMENTS

DE 20017722 1/2001

* cited by examiner

*Primary Examiner*—Jerome W. Donnelly
(74) *Attorney, Agent, or Firm*—Woodcock Washburn LLP

(57) ABSTRACT

This invention is related to an actuation mechanism which comprises a frame having a coupling portion; two engagement members meshed with each other and rotatably mounted; each of the engagement members has a first pivoting portion and a second pivoting portion; two traction members with one end thereof pivotally connected with the first pivoting portion of the engagement member, and the other ends of the traction members are pivotally connected with each other; at least one resilient member having one end mounted on the coupling portion of the frame, and the other end mounted on one of the traction members; at and at least two connecting rods and at least one base plate, each of the connecting rods has two opposing ends with one end thereof being pivotally connected with the second pivoting portion of the engagement member, and the other end thereof being pivotally connected with the base plate.

15 Claims, 8 Drawing Sheets

ACTUATION MECHANISM OF EXERCISER

CROSS-REFERENCES TO RELATED APPLICATIONS

U.S. patent application Ser. No. 09/669,629 German Patent No. DE 20017722.2

STATEMENT REGARDING FEDERALLY SPONSORED RESEARCH OR DEVELOPMENT

Not Applicable

BACKGROUND OF THE INVENTION

1. Field of the Invention

This invention is related to an actuation mechanism of an exerciser that not only can be operated by both arms of the user for the exercise of the arms, but also can be independently or simultaneously operated by both legs of the user for the exercise of the legs. Furthermore, in one operation state of the exerciser, the actuation mechanism of this invention will apply pressure on the belly of the user to further achieve the purpose of exercise of the belly.

2. Description of the Related Art

One existing arm-building exerciser, such as that disclosed in U.S. Pat. No. 6,364,816 and German Patent No. DE 20017722.2 issued on Jan. 18, 2001 and entitled "arm-building device," are hereby incorporated by references and generally illustrated in FIGS. 1 to 3. The existing arm-building exerciser comprises a housing 61 in which a frame 11 is provided. A coupling portion 15 is provided at the ends of the bottom of the frame 11. Two toothed disks 21 are rotatably mounted on the frame 11 and are engaged with each other. Each of the toothed disks 21 has a connection portion 23 and a pivoting portion 25 which is separated from the axis of the toothed disks 21 by a predetermined distance. This conventional exerciser further comprises two operation rods 31 connected at one end with the connection portions 23 of the toothed disks 21. The other ends of the two operation rods 31 can be operated by the hands of the user. In operation, the two toothed disks 21 are actuated to turn with respect to the frame 11 by the two operation rods 31. The exerciser further comprises two elongated traction members 41 and each of the traction members 41 has one end thereof pivotally connected to the pivoting portion 25 of the toothed disk 21, and the other end thereof pivotally stacked together by a bolt body 46. At least one resilient member 51 is engaged at one end with the coupling portion 15 of the frame 11, and at the other end with the bolt body 46, so as to provide a recovery resilient force. By such a design, the user can put the exerciser against the belly, as illustrated in FIG. 3. The user then pulls the two operation rods 31 outwardly away from each other and the two toothed disks 21 are thus rotated, thereby further actuating the traction members 41 to move upwardly. As a result, the resilient member 51 is stretched and the recovery resilient force is provided. The user thus feels and must overcome the resistance of the recovery force. Therefore, the object of arm-building can be achieved.

Due to busy life, people of today generally cannot spare much time for exercise. Thus, many people wish to have a multi-functional exerciser for working out various parts of human body. The existing exerciser mentioned above can only achieve the purpose of arm-building. The function provided by such an exerciser is obviously not attractive enough to the customers. In addition, a multi-functional exerciser is not only economical to the users, but also eliminates the necessity of buying additional pieces of different exercisers. Thus, the disadvantage of needing huge storage space for a plurality of exercisers can be avoided. Obviously, the existing exerciser mentioned above cannot provide the advantages of a multi-functional exerciser. Accordingly, there is a demand for a multi-functional exerciser that is economical, convenient, compact and can achieve the purpose of working out various parts of the body.

BRIEF SUMMARY OF THE INVENTION

A primary object of this invention is to overcome the disadvantages of the conventional art and meet the requirements of the modern society, and to provide an actuation mechanism of an exerciser with various actuation functions. The actuation mechanism of this invention comprises a frame having a coupling portion provided thereon; two engagement members, each having an axis, meshed with each other, and rotatably mounted on the frame at the respective axes; each of the engagement members has a first pivoting portion and a second pivoting portion which are both separated from the axis thereof by a predetermined distance; two traction members, each having two opposing ends, with one end thereof pivotally connected with the first pivoting portion of each of the engagement members, and the other ends of the two traction members are pivotally connected with each other; at least one resilient member having two ends with one end thereof mounted on the coupling portion of the frame, and the other end mounted on one of the two traction members; at least two side boards and at least two resilient connectors which respectively connect the side boards to the frame so as to provide resilient recovery force when the two side boards are compressed; and at least two connecting rods and at least one base plate, each of the connecting rods having two opposing ends with one end thereof being pivotally connected with the second pivoting portion of the engagement member, and the other end thereof being pivotally connected with the base plate.

The major technical content of this invention is that the exerciser not only can be operated by both arms of the user for the exercise of the arms, but also can be independently or simultaneously operated by both legs of the user for the exercise of the legs. Furthermore, in one operation state of the exerciser, the actuation mechanism according to this invention will apply pressure on the belly of the user to further achieve the purpose of exercise of the belly.

The structures and characteristics of this invention can be realized by referring to the appended drawings and explanations of the preferred embodiments.

DETAILED DESCRIPTION OF THE INVENTION

Figure 1:
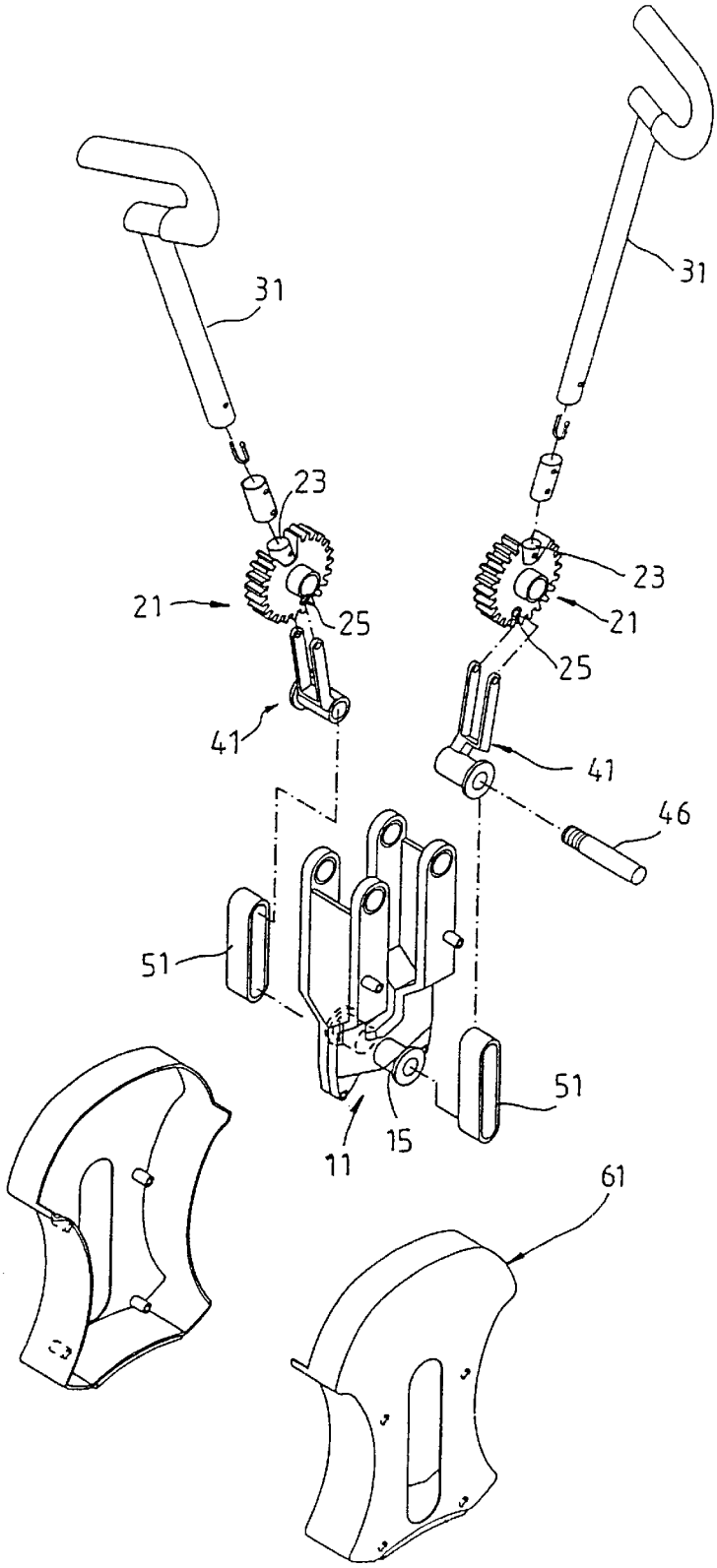
FIG.1 (PRIOR ART)
FIG. 1 is an exploded view showing a conventional exerciser.
Figure 2:
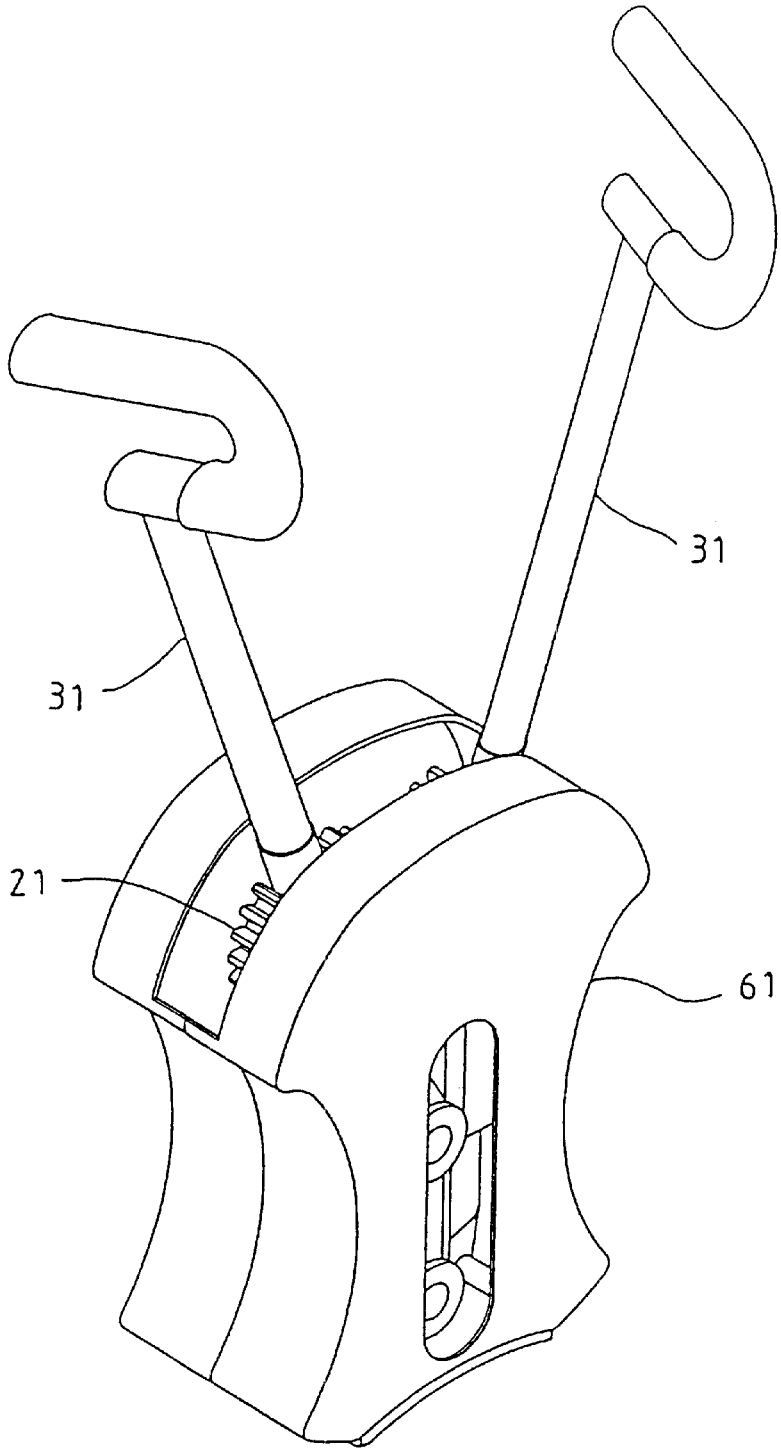
FIG.2 (PRIOR ART)
FIG. 2 is a perspective view showing the assembled conventional exerciser.
Figure 4:
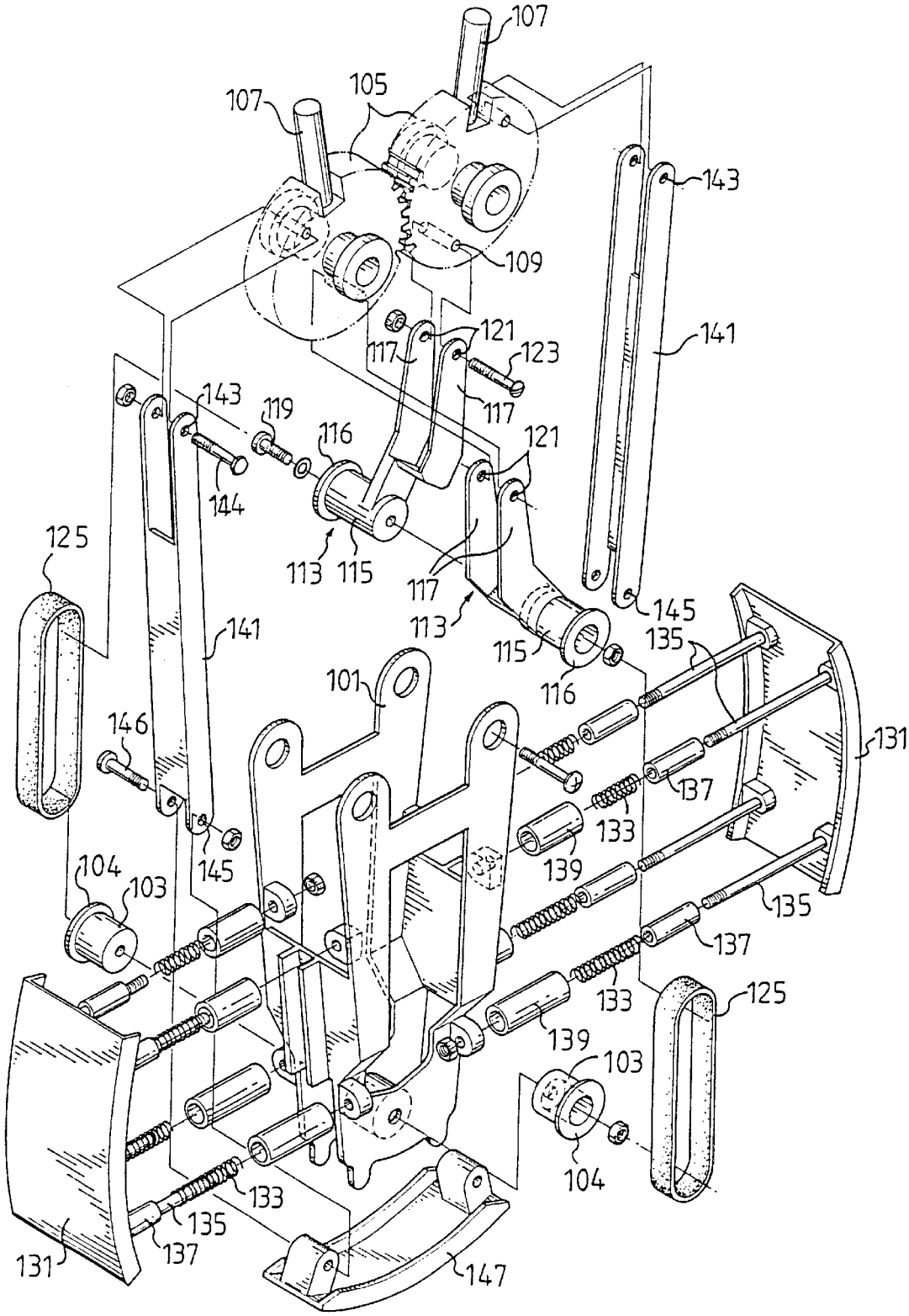
FIG. 4 is an exploded view of an actuation mechanism of exerciser according to a preferred embodiment of this invention.
Figure 5:
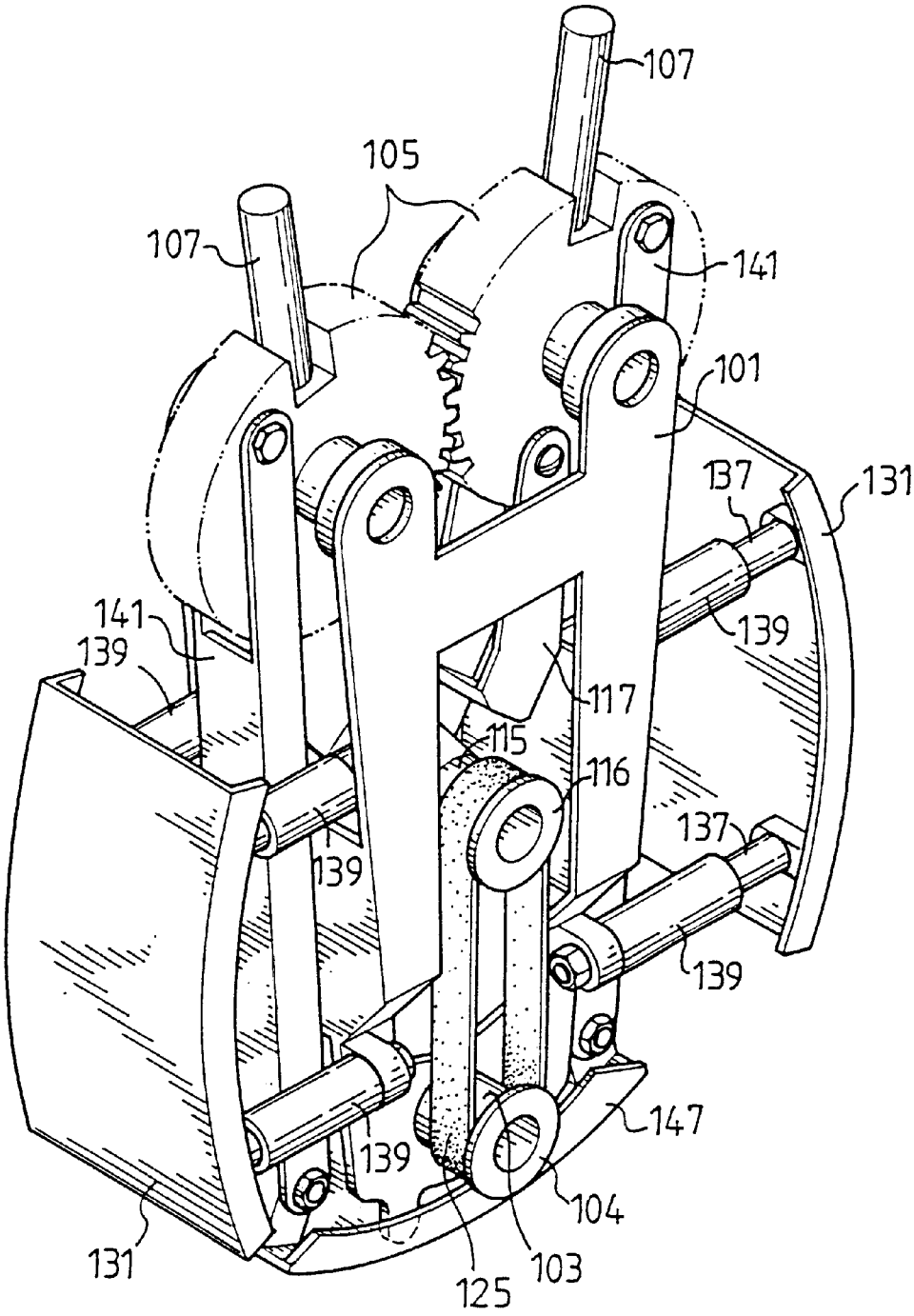
FIG. 5 is a perspective view showing the assembled mechanism according to the preferred embodiment.

FIGS. 4 and 5 are the exploded view and the perspective view of the actuation mechanism of an exerciser, before and after assembly, respectively, according to one preferred embodiment of this invention. The preferred embodiment of this invention includes a frame 101 having two pieces of H-shaped frameworks. Coupling portions 103 in cylindrical shape are provided at both sides near the bottom of the frame 101. Two engagement members, such as gears 105, are rotatably mounted on the frame 101 and can be rotated with respect to the axes thereof. Further, the two gears 105 are meshed with each other. Each of the gears 105 has a connection portion, such as a tube 107 according to the preferred embodiment of this invention, to be connected with a handle (not shown, but may be referred to the existing art shown in FIG. 1) so that the user can operate the exerciser by arms. Each of the gears 105 further has a first pivoting portion and a second pivoting portion, such as a first pivoting hole 109 and a second pivoting hole 111 shown in FIG. 4. These two pivoting holes 109 and 101 are separated from the axes of the gears 105 by a predetermined distance. This invention comprises two traction members 113, each has two opposing ends, with one end thereof being a hollow cylindrical body 115 and the other end thereof including two connecting arms 117 in parallel extending from the cylindrical body 115. The two cylindrical bodies 115 are pivotally connected by a first bolt 119 passing therethrough. Each of the connecting arms 117 has a hole 121 thereon so that a second bolt 123 can pass through this hole 121 and the first pivoting hole 109 to pivotally connect the traction member 113 and the gear 105. The actuation mechanism of exerciser of this invention further comprises at least one resilient member, such as the two rubber rings 125 according to the preferred embodiment. One end of the rubber ring 125 is mounted on the coupling portion 103 of the frame 101, and the other end of the rubber ring 125 is mounted on the cylindrical body 115 of the traction member 113. Flanges 104 and 116 are provided at the outside edges of the coupling portion 103 and the cylindrical body 115 to prevent separation of the rubber ring 125 therefrom.

In one of the preferred embodiment of this invention, the actuation mechanism further comprises two side boards 131 which are slightly convex. Each side board 131 is connected with the frame 101 by at least one resilient connector which includes a plurality of spiral springs 133, connection rods 135, and casings 137 and 139 etc. as shown in FIG. 4.

In another preferred embodiment of this invention, such as that illustrated in FIGS. 4 and 5, the actuation mechanism further includes at least two elongated connecting rods 141 having two opposing ends with one end thereof having a hole 143 to be pivotally connected with the second pivoting hole 111 of the gear 105 by a third bolt 144, and the other end having a hole 145 to be pivotally connected with a base plate 147 by a fourth bolt 146.

Figure 3:
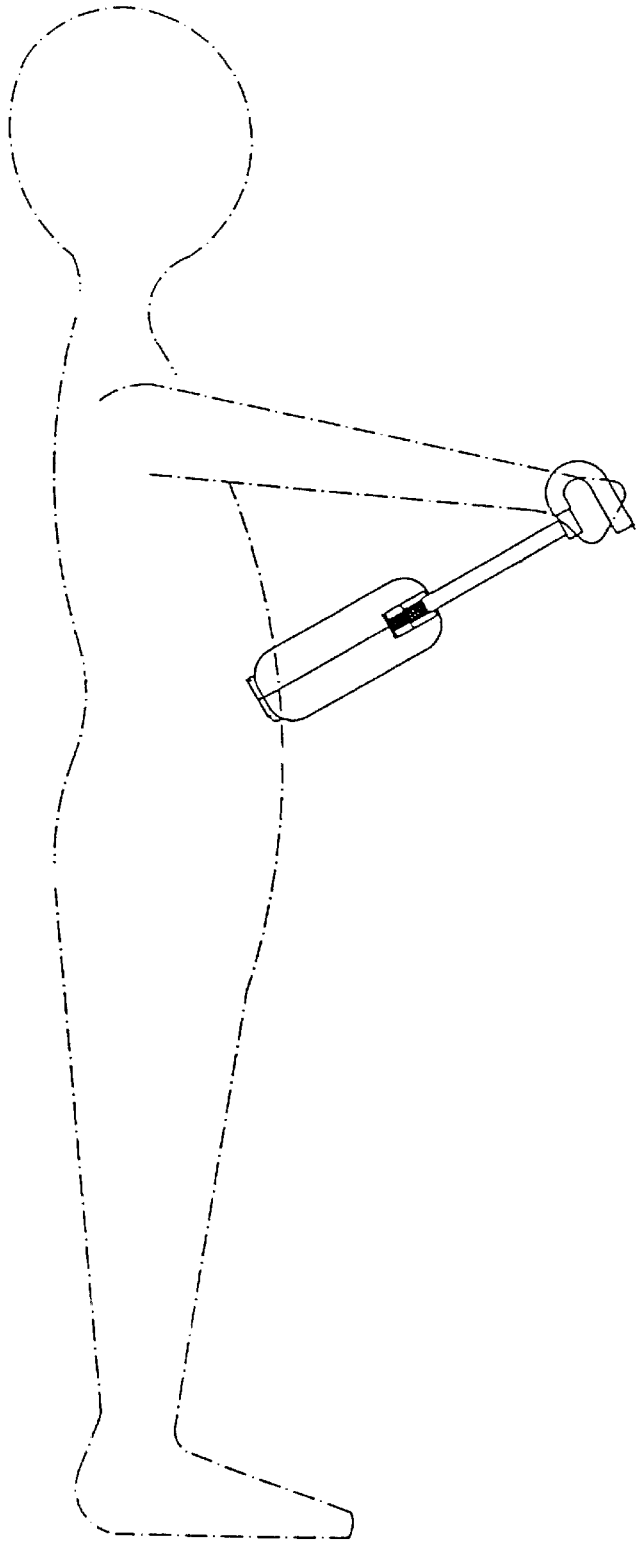
FIG.3 (PRIOR ART)
FIG. 3 is a schematic view showing the state of use of the conventional exerciser.
Figure 6:
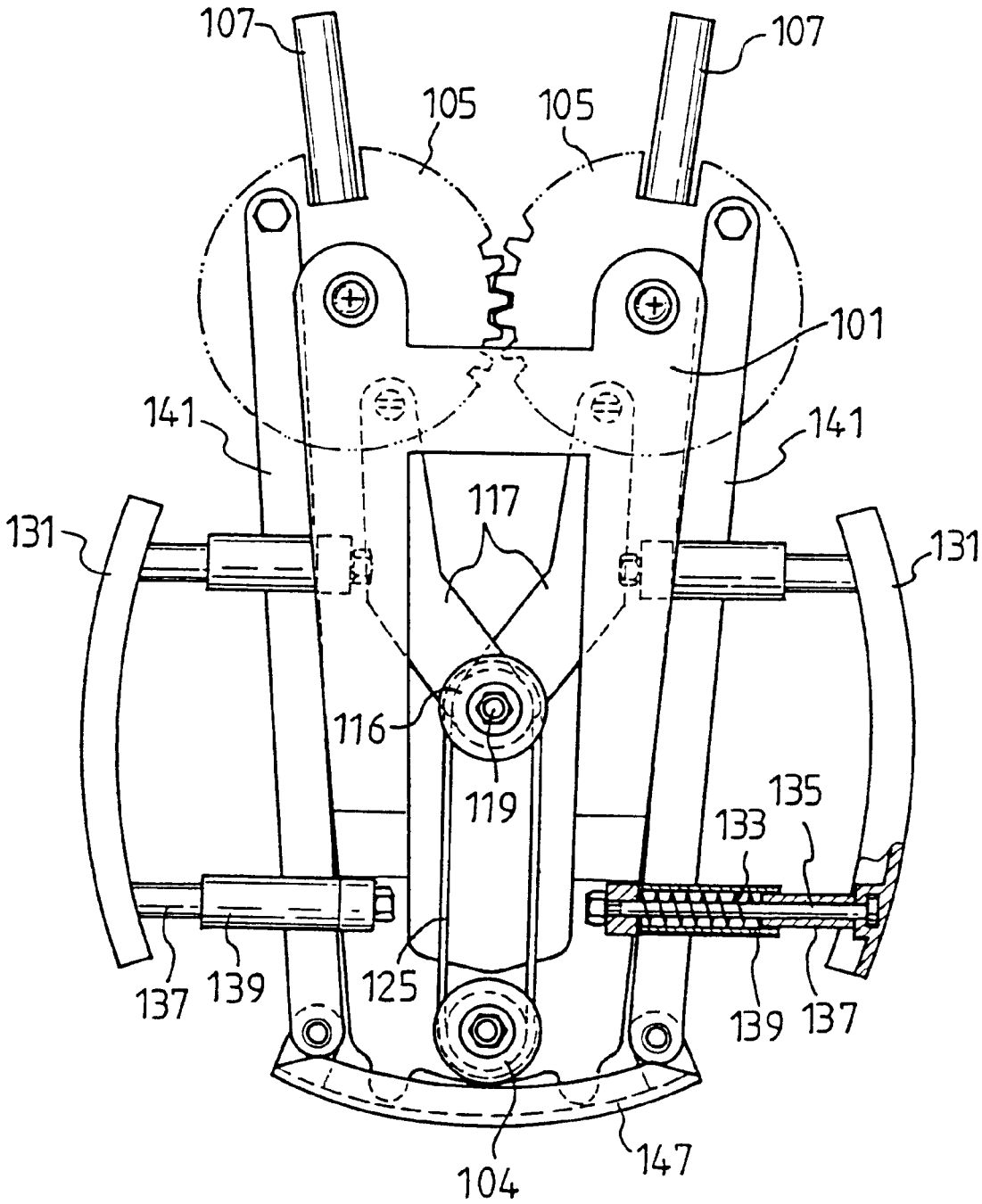
FIG. 6 is a front elevational view showing the mechanism according to the preferred embodiment prior to actuation.
Figure 7:
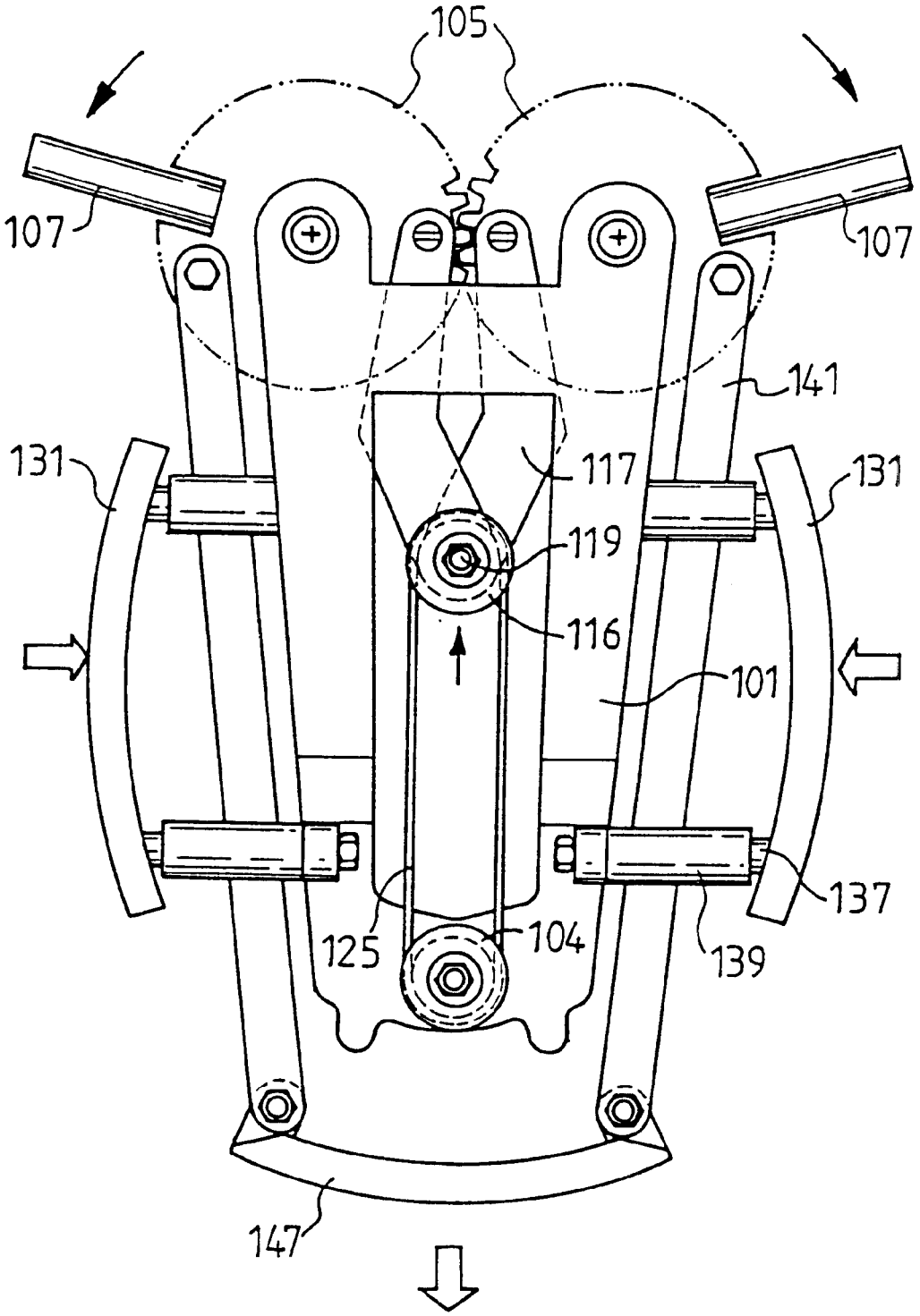
FIG. 7 is a front elevational view showing the mechanism according to the preferred embodiment after actuation.
Figure 8:
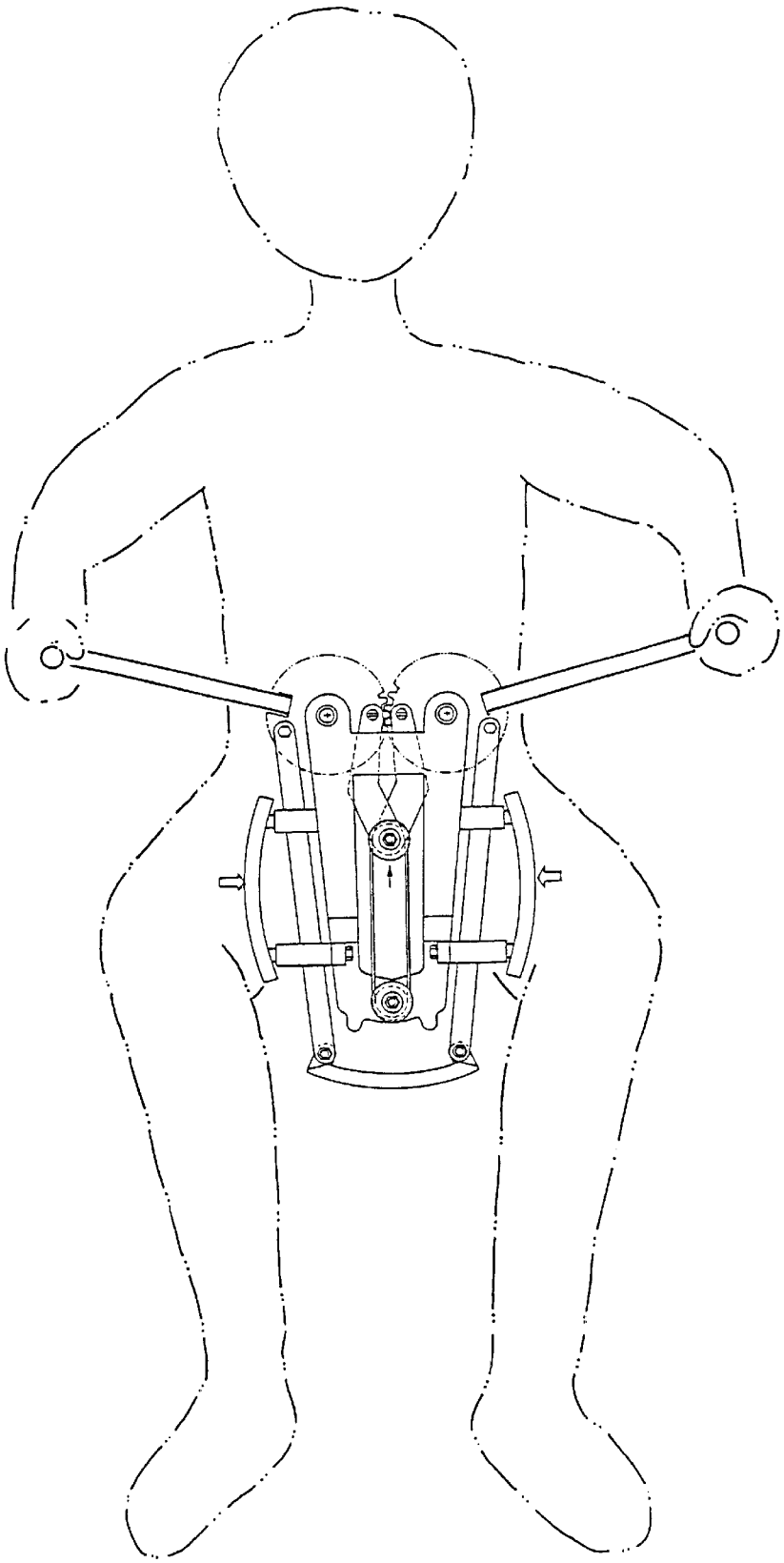
FIG. 8 is a schematic view showing the state of use of the exerciser according to the preferred embodiment of this invention in operation.

According to the primary technical contents of this invention, the user can put the exerciser, having the actuation mechanism shown in FIGS. 6 to 8, against the belly through the base plate 147, in the same manner as illustrated in FIG. 3 of existing art. The user then pulls the handles (not shown in this invention) outwardly away from each other and the two gears 105 are thus outwardly rotated by the tubes 107, as shown in FIG. 7. Because the traction members 113, including the cylindrical bodies 115 and the connecting arms 117 are pivotally connected on the gears 105, the traction members 113 will move upwardly. As a result, the rubber rings 125 are stretched and the recovery resilient force is introduced. The user thus feels and must overcome the resistance of the recovery force from the rubber rings 125 to achieve the object of arm-building. In addition, as illustrated in FIGS. 7 and 8, when the gears 105 are outwardly rotated, the connecting rods 141 pivotally connected therewith will move downwardly, so that the base plate 147 will further move toward the belly of the user. Therefore, when the exerciser according to this invention is put against the belly of the user, it will apply additional pressure on the belly, so that the user must react with counterforce by the muscle of the belly. Accordingly, the purpose of exercise of the belly is achieved.

On the other hand, the users can put the exerciser having the actuation mechanism according to this invention, between their legs, as shown in FIG. 8. Thus, when the users operate the handle for arm-building, they can at the same time apply inward pressure on the side boards 131 by their legs. Since each of the side board 131 is connected with the frame 101 by the elements including a plurality of spiral springs 133, as shown in FIG. 4, the spiral springs 133 will produce recovery resilient force after compression so that the users will feel the resistance from the side boards 131 when pressing the same. Thus, the purpose of exercise of legs can be achieved. Furthermore, the actuation of the side boards 131 and the actuation of the gears 105 are independent, therefore, the users can either work out the arms or legs only, or work out the arms and legs simultaneously. Thus, a single exerciser according to this invention can achieve the object of exercise of various parts of the body.

As shown in FIGS. 4 to 8 of the preferred embodiment, the actuation mechanism according to this invention may include the side boards 131 and the base plate 147 at the same time. However, as mentioned above, the actuation of the side boards 131 is irrelevant to the actuation of the gears 105, the actuation of the side boards 131 is thus independent from the actuation of the base plate 147. Accordingly, the manufacture can make a construction having the components related to the side boards 131 only, or a construction having the components related to the base plate 147 only, but either one will not depart from the claimed scope of this invention, as the installation and function thereof are independent.

This invention is related to a novel creation that makes a breakthrough to conventional art. Aforementioned explanations, however, are directed to the description of preferred embodiments according to this invention. Various changes and implementations can be made by those skilled in the art without departing from the technical concept of this invention. Since this invention is not limited to the specific details described in connection with the preferred embodiments, changes to certain features of the preferred embodiments without altering the overall basic function of the invention are contemplated within the scope of the appended claims.

What is claimed is:

1. An actuation mechanism of an exerciser, comprising:

a frame having a coupling portion provided thereon;

two engagement members, each having an axis, the two engagement members being meshed with each other, and rotatably mounted on the frame at the respective axes; each of the engagement members having a first pivoting portion which is separated from the axis thereof by a predetermined distance;

two traction members, each having two opposing ends, with one end thereof pivotally connected with the first pivoting portion of each of the engagement members, and the other ends of the two traction members are pivotally connected with each other;

at least one resilient member having two ends with one end thereof mounted on the coupling portion of the frame, and the other end mounted on one of the two traction members; and at least two side boards and at least two resilient connectors which respectively connect the side boards to the frame to provide resilient recovery force when the two side boards are compressed.

2. The actuation mechanism of an exerciser according to claim 1, wherein the engagement members are gears.

3. The actuation mechanism of an exerciser according to claim 1, further comprises a first bolt, wherein each of the traction members has a hollow cylindrical body and two connecting arms in parallel extending from the cylindrical body, and the two cylindrical bodies are pivotally connected by the first bolt passing therethrough.

4. The actuation mechanism of an exerciser according to claim 1, further comprises two second bolts, wherein the first pivoting portion is a pivoting hole, and each of the traction members is pivotally connected at the end thereof with the engagement member by the second bolt passing through the pivoting hole.

5. The actuation mechanism of an exerciser according to claim 1, wherein the resilient member is a rubber ring.

6. The actuation mechanism of an exerciser according to claim 1, wherein each of the side boards is slightly convex.

7. The actuation mechanism of an exerciser according to claim 1, wherein each of the resilient connectors comprises a spiral spring.

8. The actuation mechanism of an exerciser according to claim 1, further comprises at least two connecting rods and at least one base plate, and each of the engagement members is further provided with a second pivoting portion, wherein each of the connecting rods has two opposing ends with one end thereof being pivotally connected with the second pivoting portion of the engagement member, and the other end thereof being pivotally connected with the base plate.

9. The actuation mechanism of an exerciser according to claim 8, wherein the second pivoting portion is a pivoting hole, and each of the connecting rods is connected to the pivoting hole by bolts.

10. An actuation mechanism of an exerciser, comprising:

a frame having a coupling portion provided thereon;

two engagement members, each having an axis, the two engagement members being meshed with each other, and rotatably mounted on the frame at the respective axes; each of the engagement members having a first pivoting portion and a second pivoting portion each being separated from the axis thereof by a predetermined distance;

two traction members, each having two opposing ends, with one end thereof pivotally connected with the first pivoting portion of each of the engagement members, and the other ends of the two traction members are pivotally connected with each other;

at least one resilient member having one end thereof mounted on the coupling portion of the frame, and the other end mounted on one of the two traction members; and at least two connecting rods and at least one base plate, each of the connecting rods having two opposing ends with one end thereof being pivotally connected with the second pivoting portion of the engagement member, and the other end thereof being pivotally connected with the base plate.

11. The actuation mechanism of an exerciser according to claim 10, wherein the engagement members are gears.

12. The actuation mechanism of an exerciser according to claim 10, further comprises a first bolt, wherein each of the traction members has a hollow cylindrical body and two connecting arms in parallel extending from the cylindrical body, and the two cylindrical bodies are pivotally connected by the first bolt passing therethrough.

13. The actuation mechanism of an exerciser according to claim 10, further comprises two second bolts, wherein the first pivoting portion is a pivoting hole, and each of the traction members is pivotally connected at the end thereof with the engagement member by the second bolt passing through the pivoting hole.

14. The actuation mechanism of an exerciser according to claim 10, wherein the resilient member is a rubber ring.

15. The actuation mechanism of an exerciser according to claim 10, wherein the second pivoting portion is a pivoting hole, and each of the connecting rods is connected to the pivoting hole by bolts.

* * * * *

UNITED STATES PATENT AND TRADEMARK OFFICE

CERTIFICATE OF CORRECTION

PATENT NO. : 6,623,410 B2 
DATED : September 23, 2003
INVENTOR(S) : Jack Tang

It is certified that error appears in the above-identified patent and that said Letters Patent is hereby corrected as shown below:

Title page,
Item [57], ABSTRACT,
Line 1, insert -- of an exerciser, -- after "mechanism";
Line 2, insert -- provided thereon -- after "portion";
Line 4, insert -- on the frame -- after "mounted";
Line 8, insert -- two -- before "traction";
Line 10, insert -- thereof -- after "end";
Line 11, insert -- two -- before "traction";
Line 11, delete "at and" after "members;";
Line 12, insert -- side boards and at least two resilient connectors which respectively connect the side boards to the frame so as to provide resilient recovery force when the two side boards are compressed; and at least two -- after "two";

Column 3,
Line 28, delete "101" and insert -- 111 -- therefor;

Column 5,
Line 16, insert -- so as -- after "frame".

Signed and Sealed this

Twenty-third Day of March, 2004

JON W. DUDAS
*Acting Director of the United States Patent and Trademark Office*